United States Patent [19]

Taylor

[11] 4,096,707

[45] Jun. 27, 1978

[54] PORTABLE REFRIGERATION MACHINE

[76] Inventor: William P. Taylor, 4541 Lyme Bay, Oxnard, Calif. 93030

[21] Appl. No.: 733,360

[22] Filed: Oct. 18, 1976

[51] Int. Cl.[2] ..... F25D 3/12

[52] U.S. Cl. ..... 62/167; 62/387

[58] Field of Search ..... 62/186, 404, 165, 171, 62/384, 514 R, 166, 387, 167; 165/168, 169

[56] References Cited

U.S. PATENT DOCUMENTS

| | | | |
|---|---|---|---|
| 1,917,865 | 7/1933 | Wood | 62/387 |
| 2,006,534 | 7/1935 | Bridges | 236/38 |
| 2,231,329 | 2/1941 | Goll | 165/169 |
| 3,086,283 | 4/1963 | Webber et al. | 165/169 |
| 3,164,971 | 1/1965 | Gentz | 62/387 |
| 3,855,816 | 12/1974 | Miller | 62/387 |

*Primary Examiner*—William E. Wayner
*Attorney, Agent, or Firm*—Ralph B. Pastoriza

[57] ABSTRACT

A portable refrigeration machine includes a vertically oriented pressure vessel containing carbon dioxide in gaseous, liquid and/or solid states. A heat exchanger is secured to the lower external portion of the vessel and an outer housing surrounds the vessel to leave an annulus between the exterior wall of the vessel and the interior wall of the housing. A gas pressure operated fan is disposed beneath the heat exchanger and connected for operation by gas pressure from the vessel to rotate. The fan draws in air through appropriate lower inlet openings which air passes through the heat exchanger and annulus out outlet opening to thereby cool and circulate the air in a compartment within which the portable refrigeration machine is placed.

2 Claims, 4 Drawing Figures

PORTABLE REFRIGERATION MACHINE

This invention relates generally to refrigerators and more particularly to an improved portable refrigeration machine for use in areas in which electrical power normally required for the operation of a refrigeration unit is not available.

BACKGROUND OF THE INVENTION

Conventional refrigeration units usually employ a number of coils through which an expanding gas is passed such as Freon. The expanding gas results in cooling of the coils which in turn through heat exchange with the interior of a compartment provide a refrigerated area. Normally, electrically operated compressors and pumps are required for these systems.

In areas where electricity is not available or in instances where a person is travelling, a portable type refrigeration machine not requiring electrical energy would be very useful. The problem is solved in many instances by simply providing ice blocks inside of an insulated chest. In other instances, dry ice is utilized but in the latter situations, an egress means must be found for the gas evolved from the dry ice.

In the latter above-mentioned refrigeration units, no forced air circulation is involved which results in the further disadvantage that warm air tends to stay near the top and the colder air near the bottom of the refrigerated compartment.

There is a need for an improved refrigeration machine for portable refrigeration which could also be expendable in various applications such as airline food storage modules for storing passenger meals, food carts used in institutions for storing food, airline cargo containers used to transport perishables and possibly insulated trucks and railway cars.

BRIEF DESCRIPTION OF THE PRESENT INVENTION

The present invention contemplates a greatly improved portable refrigeration machine which can be placed in compartments containing food or the like to be refrigerated and yet which requires no electrical energy for operation and further functions to cool the interior of the compartment throughout its volume to a uniform temperature. This cooling is accomplished by cool air circulation wherein a fan is provided which operates off the refrigeration medium itself and thus does not require external electrical energy.

More particularly, in accord with the present invention, there is provided a vertically oriented pressure vessel receiving carbon dioxide in gaseous, liquid and/or solid states. A heat exchanger is secured to the lower external portion of this vessel and an outer housing surrounds the vessel in spaced relationship to leave an annulus between the exterior wall of the vessel and the interior wall of the housing above the heat exchanger. The housing itself includes upper and lower outlet openings and a gas operated fan beneath the heat exchanger.

The gas operated fan is connected through an appropriate conduit means to the upper interior of the vessel so that expanding gas passes through the conduit to operate the fan thereby circulating air in through the lower opening, heat exchanger, annulus and out the upper opening.

Additional features of the invention include appropriate thermal control means to maintain the temperature within given limits and appropriate means to assure a more uniform temperature throughout the entire volume of a compartment within which the portable refrigeration machine is used.

BRIEF DESCRIPTION OF THE DRAWINGS

A better understanding of this invention will be had by now referring to the accompanying drawings in which.

DETAILED DESCRIPTION OF THE INVENTION

Figure 1:
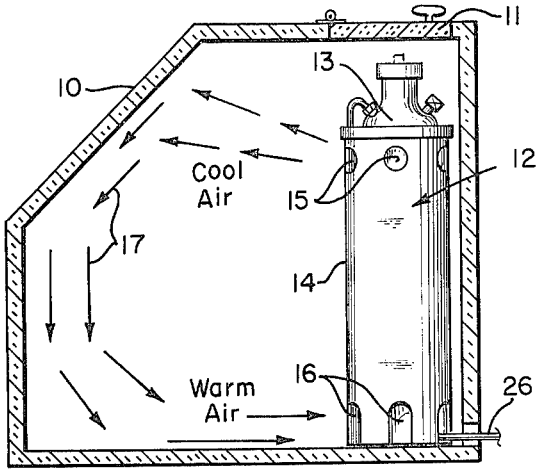
FIG. 1 is a cross section of a cabinet illustrating the portable refrigeration machine of this device in full lines disposed within the cabinet for cooling the interior thereof.

Referring first to FIG. 1, there is shown a refrigeration compartment 10 which might be a food storage container used on airlines or any other appropriate insulated enclosure which is to be temporarily refrigerated. Cabinet 10 is provided with an access door 11 for receiving food or other items to be refrigerated as well as the portable refrigeration machine of the present invention shown in full lines at 12 disposed within the interior of the cabinet.

As will become clearer as the description proceeds, the portable refrigeration machine 12 includes a pressure vessel 13 containing a cooling medium such as carbon dioxide in gaseous liquid and/or solid phase and a surrounding housing 14. Actual cooling is accomplished by circulating cool air out upper openings 15 in the housing 14 about the interior of the cabinet and thence into lower inlet openings 16. The circulating cooling air flow is indicated by the arrow 17.

The foregoing cooling arrangement described in FIG. 1 is the reverse of the normal temperature gradient of air in the compartment; that is, normally the warmer air will be in the upper region. By introducing the cooled air at this point and causing it to flow downwardly, the entire interior volume can be maintained at a relatively uniform temperature.

Figure 2:
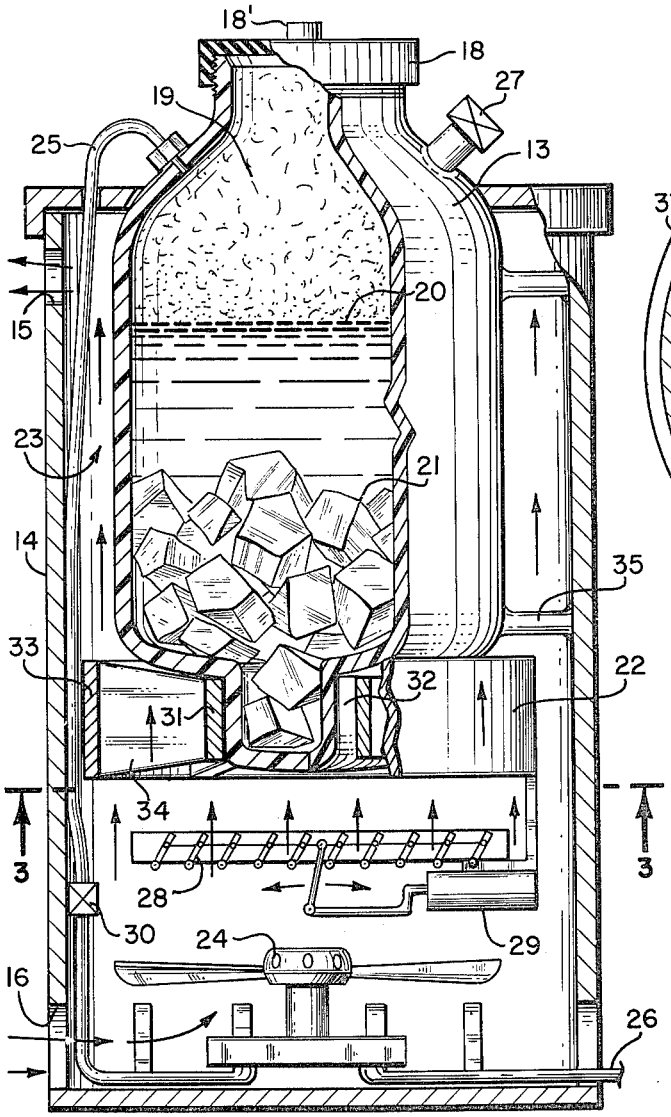
FIG. 2 is a greatly enlarged view partly in cross section and partly broken away of the portable refrigeration machine itself.

Referring now to the enlarged view of FIG. 2 details of the portable refrigeration machine will be evident. As shown, the pressure vessel 13 is provided with a removable cap 18 for introducing carbon dioxide in liquid and/or solid phases. When liquid is introduced, the cap remains on the vessel and liquid is received through a pressure coupling 18' provided on the cap. Gaseous carbon dioxide indicated at 19 will be developed under pressure from the liquid and/or solid phases shown at 20 and 21.

A heat exchanger 22 details of which will be described subsequently is secured to the lower external portion of the vessel 13. The outer housing 14 in turn surrounds the vessel in spaced relationship thereto to leave an annulus 23 between the exterior wall surface of the vessel 13 and the interior wall surface of the housing 14 above the heat exchanger 22.

A gas operated fan 24 is disposed beneath the heat exchanger 22 and is arranged to be powered by gaseous carbon dioxide supplied from the upper interior of the vessel 13 as by an appropriate conduit 25. Exhaust carbon dioxide gas after passing through the gas operated fan 24 may be conducted to the exterior of the housing and any cabinet structure in which the machine is placed as indicated at 26 in both FIGS. 1 and 2.

As briefly described heretofore, the charge in the pressure vessel 13 can be a combination of solid phase (dry ice) and gas, or a combination of liquid and gas. If only the solid and gaseous phases are present, the solid sublimes as heat is added to the charge. If only the liquid and gaseous phases are present, the liquid vaporizes (boils) as heat is added to the charge.

Most commonly all three phases are present and the carbon dioxide is described as being in its "triple point". In this unique state, the pressure remains fixed at about 75 lbs. per sq. inch absolute and the temperature at about −70° F so long as all three phases are present. If the gas is tapped at a constant rate to operate the turbine powered fan 24 through the conduit 25 the solid phase portion of the charge will slowly disappear if the heat added to the pressure vessel exceeds the heat required to produce the gas being tapped. Conversely, if the heat added is less than that required to produce the gas being tapped, the liquid phase will slowly disappear.

When the solid phase disappears leaving only liquid and gas, the internal pressure in the vessel normally will increase. This pressure is prevented from damaging the machine by a pressure relief valve on the upper portion of the vessel shown at 27. This valve will relieve the internal pressure of the $CO_2$ gas should it exceed a given safe value.

As indicated by the various arrows in FIG. 2, when the fan 24 is driven by carbon dioxide gas passed from the conduit 25 to the exhaust 26, air will be caused to enter the lower inlet opening 16 and pass through the fan and heat exchanger 22 up through the annulus 23 and thence out the outlet opening 15. The cool air is thus introduced into the upper region of any refrigerated cabinet within which the machine is placed as described in FIG. 1.

In order to maintain the temperature of the air within a given range, a thermally responsive baffle structure may be provided. Thus, referring to the lower portion of FIG. 2 a baffle plate structure 28 is positioned between the fan and heat exchanger 22. Appropriate thermal means 29 is connected to the baffle plate structure for increasing or decreasing the air flow passage from the fan to the heat exchanger and annulus in response to increasing or decreasing temperatures respectively falling outside given temperature limits. Any appropriate type of air baffle operable by any appropriate thermal responsive means can be used. In the particular schematic illustration shown, various slats similar to a Venetian blind are simply rotated through the connection to the thermal responsive means 29 which in turn may constitute any appropriate temperature transducer converting temperature change into physical movement such as a bimetallic strip structure or fluid filled bellows.

Since cooler air is introduced in the upper portion of the compartment to be refrigerated and warm air withdrawn near the bottom, the established temperature distribution, as briefly alluded to herebefore, is the reverse of a natural circulation distribution, which latter natural circulation distribution results in warmer air at the top. An added feature to the present machine can be made which superimposes a natural circulation pattern on the machine circulation pattern to result in a narrower temperature control band. This modification is accomplished by incorporating a cycling valve such as schematically indicated at 30 in FIG. 2 in the conduit 25 between the pressure vessel and turbine operated fan. This cycling valve periodically interrupts the flow of gas to the fan so that the fan is operated intermittently to thereby provide inactive time intervals during which the air in the refrigeration compartment in which the machine is placed can redistribute itself thus providing a more uniform temperature throughout the volume of the refrigeration compartment to be cooled. Because of this more uniform temperature, the temperature limits of operation of the baffle can be brought closer together and thus a narrower temperature band utilized.

Figure 3:
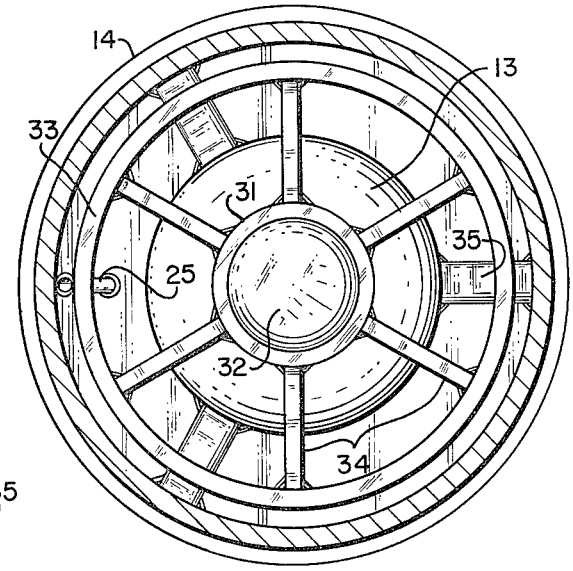
FIG. 3 is a cross section taken in the direction of the arrows 3—3 of FIG. 2; and, FIG. 4 is a fragmentary view partly in cross section of a portion of the machine of FIG. 2 illustrating a modification.

Referring now to the cross section of FIG. 3, details of the heat exchanger 22 described in FIG. 2 are shown. Thus, the heat exchanger itself includes an inner collar 31 surrounding in intimate physical contact a decreased diameter lower portion 32 of the pressure vessel 13. A press fit may be used to secure the inner collar to this decreased diameter portion to provide a physically tight fit so that the engaging physical surfaces are in good heat conductive contact.

An outer collar 33 is coaxially arranged with the inner collar and is of greater diameter. A plurality of flat fin plates 34 in turn are vertically oriented and extend radially from the exterior wall of the inner collar to the interior wall of the outer collar. These plates are secured to the collars in heat conducting relationship so that air passing upwardly between the fin plates 34 into the annulus 23 as described in FIG. 2 give up heat to the inner and outer collars and fin plates.

In FIG. 3, only six fin plates are shown but it should be understood that many more could be provided. It will also be understood that the outer collar 33 is supported by the fin plates extending from the inner collar which in turn is supported on the lower end of the pressure vessel 13. Pressure vessel 13 itself is supported within the housing 14 as by appropriate radial struts such as indicated at 35 in both FIGS. 2 and 3.

Figure 4:
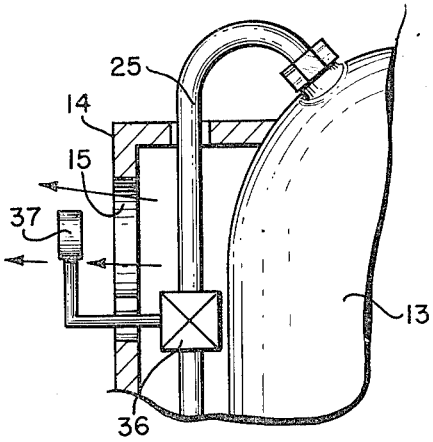

Referring now to FIG. 4, there is shown a modification of the portable refrigeration machine of FIG. 2 which enables elimination of the baffle plate structure 28 and thermal control 29. In FIG. 4, this modification takes the form of a thermostatically controlled valve 36 adjacent to the outlet opening 15 of the housing 14 interposed in the conduit 25 from the vessel to the fan. Control of the valve 36 is effected by an appropriate thermostat 37 which will cause the valve to operate and close the conduit when the temperature of the cooled air drops below a given lower limit, and open up the conduit when the temperature goes above a given upper limit. The temperature of the circulating air can thus be maintained within a given range.

From all of the foregoing, it will be evident that the present invention has provided a greatly improved portable refrigeration machine which can be readily utilized in areas where no electricity is available and is particularly useful for refrigerating compartments and the like such as used to store food on airlines, buses, and other similar situations. Further, the refrigeration unit itself can be easily removed as a unit from the refrigeration compartment since it need not be fixed to the compartment itself as is often the case with other refrigeration systems.

In using the word "vertical" to describe the orientation of the pressure vessel, it will be understood that the vessel could be elongated in a horizontal direction. It is only necessary that the heat exchanger be at the lowest point of the vessel to contact the coldest portion and in this sense, the vessel is "vertically" above the heat exchanger. Further, the fan could be located at a point other than "below" the heat exchanger. Any position in which it can push or suck air across the heat exchanger would be acceptable.

I claim:

1. A portable refrigeration machine including, in combination:

(a) a pressure vessel for receiving carbon dioxide in liquid and/or solid phases;

(b) a heat exchanger secured to the lower external portion of said vessel;

(c) an outer housing surrounding said vessel in spaced relationship thereto leave an annulus between the exterior wall surface of the vessel and the interior wall surface of said housing above said heat exchanger, said housing having an upper air outlet opening communicating with said annulus and a lower air inlet opening disposed beneath said heat exchanger;

(d) a gas operated fan disposed to cause air flow across said heat exchanger;

(e) conduit means connecting the upper interior of said vessel to said gas operated fan to rotate said fan by expanding carbon dioxide gas from said vessel and thereby causing air to enter said inlet opening and pass through said heat exchanger and annulus out said outlet opening, said heat exchanger absorbing heat in said air into said vessel whereby said air passing out said outlet opening is cool;

(f) temperature responsive control means including a baffle plate structure between said fan and said heat exchanger;

(g) thermal means connected to said baffle plate structure for increasing or decreasing the air flow passage therethrough from the fan to the annulus in response to increasing or decreasing temperatures respectively falling outside given upper and lower temperature limits whereby the temperature of the circulating air is maintained within a desired range; and (h) a cycling valve interposed in said conduit between said vessel and fan for periodically interrupting the flow of gas to said fan so that said fan is operated intermittently to thereby provide inactive time intervals during which the air in a refrigerated compartment in which said machine is placed can redistribute itself to thereby provide a more uniform temperature throughout the volume of the refrigeration compartment to be cooled.

2. A portable refrigeration machine including, in combination:

(a) a pressure vessel for receiving carbon dioxide in liquid and/or solid phases;

(b) a heat exchanger secured to the lower external portion of said vessel;

(c) an outer housing surrounding said vessel in spaced relationship thereto to leave an annulus between the exterior wall surface of the vessel and the interior wall surface of said housing above said heat exchanger, said housing having an upper air outlet opening communicating with said annulus and a lower air inlet opening disposed beneath said heat exchanger;

(d) a gas operated fan disposed to cause air flow across said heat exchanger;

(e) conduit means connecting the upper interior of said vessel to said gas operated fan to rotate said fan by expanding carbon dioxide gas from said vessel and thereby cause air to enter said inlet opening and pass through said heat exchanger and annulus out said outlet opening, said heat exchanger absorbing heat in said air into said vessel whereby said air passing out said outlet opening is cooled; and, (f) a thermostatically controlled valve adjacent to said outlet opening interposed in said conduit from said vessel to said fan for closing off the conduit when the temperature of cooled air drops below a given lower limit, and opening up the conduit when the temperature rises above a given upper limit, whereby the temperature of the circulating air is maintained within a given range.

* * * * *